United States Patent [19]

Siffert

[11] Patent Number: 4,572,470

[45] Date of Patent: Feb. 25, 1986

[54] NON-REMOVABLE PICTURE FRAME HANGER AND HANGING METHOD

[75] Inventor: David W. Siffert, 420 S. Union, Traverse City, Mich. 49684

[73] Assignee: David E. Siffert, Williamsburg, Mich.

[21] Appl. No.: 305,487

[22] Filed: Sep. 25, 1981

[51] Int. Cl.[4] ..... A47F 7/14

[52] U.S. Cl. ..... 248/551; 248/489

[58] Field of Search ..... 248/551, 475 R, 476, 248/479, 487, 477, 478, 495, 496, 489, 466, 359, 360; 40/152.1, 201

[56] References Cited

U.S. PATENT DOCUMENTS

| | | | |
|---|---|---|---|
| 1,187,787 | 6/1916 | Seubert | 248/489 |
| 1,314,548 | 9/1919 | Taylor | 248/489 |
| 1,959,745 | 5/1934 | Stout | 248/489 |
| 3,039,727 | 6/1962 | Engel, Jr. et al. | 248/551 |
| 3,125,316 | 3/1964 | Wilmhoff | 248/28 |
| 3,211,409 | 10/1965 | Zimmermann | 248/551 |
| 3,612,469 | 10/1971 | Dennis | 248/475 |
| 3,709,456 | 1/1973 | Pietsch | 248/551 |
| 3,804,360 | 4/1974 | Stecker | 248/489 |
| 3,952,436 | 4/1976 | Kuhnke | 40/152.1 |
| 4,065,083 | 12/1977 | Gassaway | 248/551 |
| 4,074,888 | 2/1978 | Garner | 248/475 |
| 4,385,744 | 5/1983 | Sherman | 248/551 |

FOREIGN PATENT DOCUMENTS

| | | | |
|---|---|---|---|
| 811369 | 8/1951 | Fed. Rep. of Germany | 40/152.1 |

*Primary Examiner*—Reinaldo P. Machado
*Assistant Examiner*—Alvin Chin-Shue
*Attorney, Agent, or Firm*—John A. Waters

[57] ABSTRACT

A non-removable hanger for a picture frame comprises a pair of flat hanger members having openings at each end, threaded fasteners for pivotably attaching lower ends of the hanger members to opposite vertical sides of the frames and threaded fasteners for attaching upper ends of the hanger members to the wall. The hanger members are attached to the wall after being attached to the back of the frame by rotating or pivoting the picture frame against the wall so that the ends of the hanger members are alternately exposed. The exposed ends are screwed into the wall. A spring lock engages the hanger members and prevents them from pivoting once the frame is mounted and positioned in its proper vertical position.

13 Claims, 11 Drawing Figures

NON-REMOVABLE PICTURE FRAME HANGER AND HANGING METHOD

BACKGROUND OF THE INVENTION

1. Field of the Invention

This invention relates to devices for hanging picture frames to walls and more particularly to a non-removable device for hanging a picture frame to a wall.

2. Background of the Invention

In many public areas where art work is displayed, such as hotels, motels, or the like, it is desirable to mount the art work on the wall in such a manner that it can not easily be removed. The conventional means for hanging a picture, wherein a cable strung across the back of the frame is hooked on a hook on the wall, makes it very easy for art work to be stolen.

A number of devices have been developed for mounting pictures or mirrors on a wall in a manner that prevents easy removal. The most common method used for mounting works of art mounted in wooden picture frames is to simply screw the wooden picture frame to the wall. This causes disfiguration of the front surface of the wooden picture frame, however, and is aesthetically unpleasing.

The present invention comprises an improvement in non-removable or theft-proof picture frame mounting devices that provides a simple, easy to use, and inexpensive mounting device that discourages theft of art work.

SUMMARY OF THE INVENTION

In accordance with the present invention, a non-removable hanger for mounting a picture frame on a wall comprises a pair of elongated hanger members that fit behind the vertical sides of the picture frame. Fasteners are provided for pivotably attaching lower ends of the hanger members to the back surfaces of opposite vertical sides of the picture frame, the hanger members being attached to the frame such that the upper ends of the hanger members are pivotal outwardly to an accessible position on the outer side of the picture frame. Fasteners also are provided for alternately pivotably attaching the outwardly extending upper ends of the hanger members to the wall, such that after the hanger members are both attached to the wall and the picture frame is suspended by the hanger members, the hanger members are substantially in a vertical position with the upper ends of the hanger members positioned behind the vertical sides of the picture frame.

A releasable spring locking device interconnecting the hanger member and the back of the picture frame prevents removal of the picture frame by pivoting the picture frame so as to expose the fasteners holding the ends of the hanger members to the wall. A number of different types of locking mechanisms can be employed to accomplish this locking function.

These and other features and advantages of the present invention will hereinafter appear, and, for purposes of illustration, but not of limitation, preferred embodiments of the present invention are described in detail below and shown in the appended drawings.

DETAILED DESCRIPTION OF PREFERRED EMBODIMENTS

Figure 1:
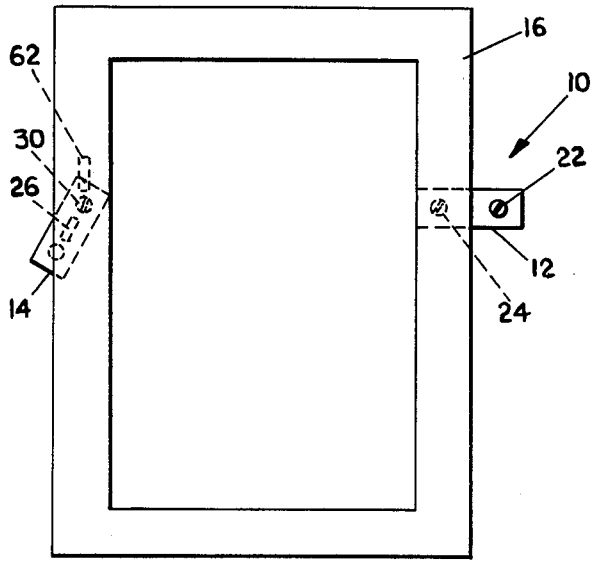
FIG. 1 is a front elevational view of a picture frame being mounted to a wall using the picture hanger of the present invention, showing the hanger member on the right side of the picture frame (FIG. 1 orientation) being mounted to the wall, with the left hand hanger member still being unmounted.
Figure 2:
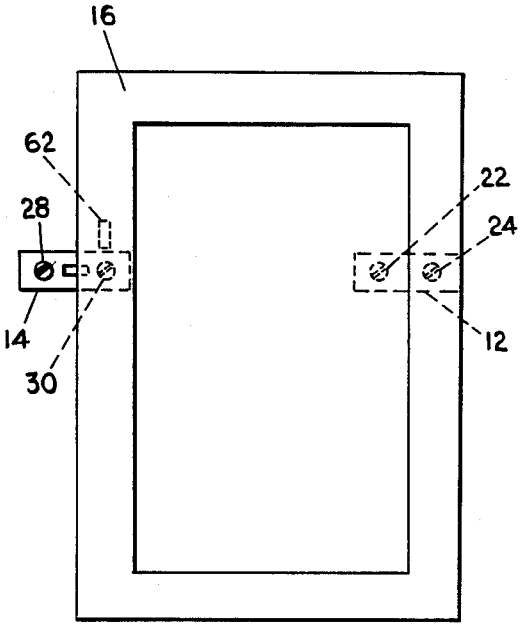
FIG. 2 is the same view as FIG. 1, showing the hanger member on the left hand side of the picture frame being mounted on the wall after the right hand member has been mounted on the wall.
Figure 3:
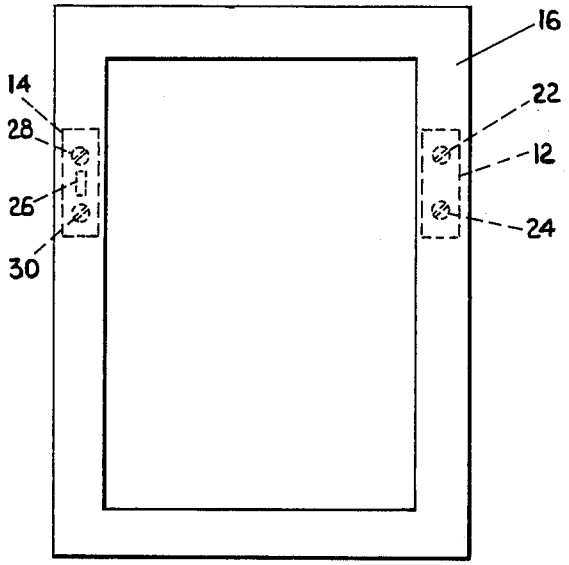
FIG. 3 is the same view as FIGS. 1 and 2 showing the picture frame after it is fully mounted on the wall.

Referring now to the drawings, a non-removable hanger assembly 10 is shown at various stages of being mounted on a picture frame 16 in FIGS. 1–3, and details of various embodiments of hanger members are shown in FIGS. 4–10.

Figure 4:
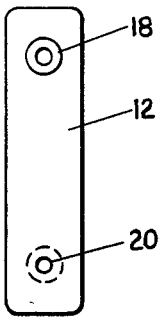
FIG. 4 is a face view of the front surface of the hanger member of the present invention.

The hanger assembly 10 of the present invention comprises a pair of hanger members 12 and 14 attached by fasteners to opposite vertical sides of a picture frame 16. As shown in FIG. 4, each hanger member 12 comprises a flat elongated plate or clip having spaced openings 18 and 20 at upper and lower ends thereof, respectively, for receiving threaded fasteners 22 and 24, respectively. Openings 18 and 20 are countersunk on opposite sides of the plate in the manner shown in FIGS. 7 and 8.

Hanger member or clip 14 is constructed in substantially the same manner as the basic clip 12, except that it includes a spring locking device 26, several embodiments of which are disclosed in FIGS. 5–10.

Deferring consideration of the locking device for the present moment, the clips are mounted to the picture frame and the picture frame mounted to the wall by the following method: First, two clips are mounted at the same position on opposite vertical sides of the picture frame. Desirably, they are mounted to the picture frame approximately $\frac{1}{3}$ of the distance from the top of the picture. Fasteners fit within the countersunk openings in the clips so that the fasteners do not extend outwardly beyond the flat surfaces of the clips facing the wall. With the clips constructed in this manner, the fasteners do not scratch the wall as the picture is pivoted back and forth on the wall in mounting the frame on the wall.

After the clips have been mounted to the back of the frame, clip 12 is pivoted outwardly to the right, in the manner shown in FIG. 1. The clips are formed so that after they have been mounted on the picture frame, the other end of the clip (referred to as the upper end of the clip by virtue of its position when the picture frame is hanging from the wall) extends outwardly from the picture frame and the opening in the upper end of the clip is accessible. Fastener 22 is then inserted through opening 18 in the upper end of the clip and is screwed to the wall. The fasteners nest in the countersunk surface in the clips so the heads of the fasteners lie below the surface of the clip, thereby preventing the fasteners from scratching the back of the frame.

After the right hand clip 12 has been mounted, the frame is pivoted to the right (FIG. 1 orientation) about the axis of fastener 22 until clip 12 extends inwardly from the frame and fastener 22 lies inside the fastener 24 (FIG. 2). At this point, hanger member or clip 14 is pivoted upwardly to the horizontal position shown in FIG. 2, and fastener 28 is inserted through the opening in the upper end of that clip and screwed to the wall. Fastener 30 holds the lower end of clip 14 to the back of the frame.

After fastener 28 has been screwed to the wall, the picture frame is then pivoted in a clockwise direction downwardly to the position shown in FIG. 3. As shown, the picture frame is suspended from the hanger in this position, and the hanger members are positioned vertically behind the vertical sides of the frame, with the upper ends of the hanger members being concealed from view.

The foregoing structure is adequate in many cases to prevent theft of pictures mounted on the wall. With the structure employing only clips of the type shown in FIG. 4, however, it would be possible to pivot the frame back and forth to remove the hanger members from the wall and thereby remove the picture from the wall. To prevent this, locking member 26 is employed to lock the frame in the vertical position shown in FIG. 3 after both hanger members have been mounted to the back of the frame and to the wall. Several constructions of locking members are shown in FIGS. 5–10.

Figure 5:
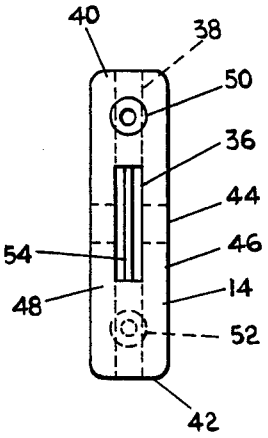
FIG. 5 is a face view of a second embodiment of a hanger member of the present invention.
Figure 7:
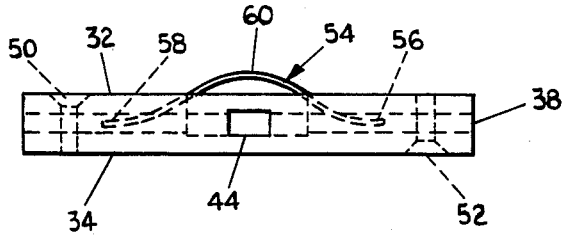
FIG. 7 is a side view of the hanger member shown in FIG. 5.
Figure 6:
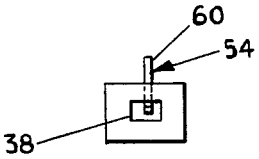
FIG. 6 is an end view of the hanger member shown in FIG. 5.
Figure 9:
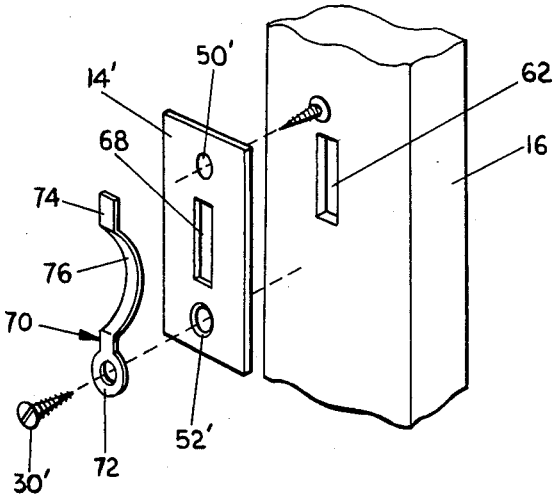
FIG. 9 is an exploded perspective view of a third embodiment of a hanger member constructed in accordance with the present invention, showing the manner in which the hanger member is attached to the back of a frame.
Figure 11:
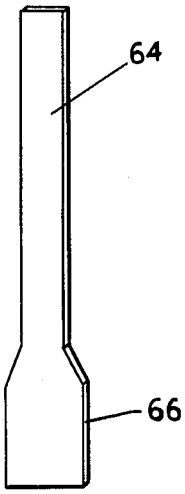
FIG. 11 is a perspective view showing a hanger release tool employed in the present invention.
Figure 8:
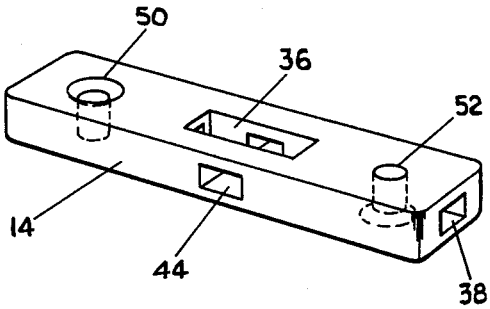
FIG. 8 is a perspective view of the hanger member shown in FIGS. 5, 6 and 7.

In FIG. 5, hanger member 14 comprises an elongated flat bar having flat upper and lower surfaces 32 and 34. These surfaces engage the back of the frame and the wall and are smooth to prevent scratching of the frame and wall. The bar can be formed of a moldable plastic material or metal. A longitudinally oriented rectangular opening or recess 36 is formed in surface 32. A longitudinal opening 38 extends between ends 40 and 42 of the bar through recess 36. A transverse opening 44 also extends through the recess through sides 46 and 48 of the bar. An upper end opening 50 having a countersunk portion adjacent side 32 and an opening 52 having a countersunk portion adjacent side 34 are formed through the hanger member for mounting the hanger member on the frame and wall. A curved spring clip 54 has ends 56 and 58 that fit within the interior of channel 38 and a central portion 60 that protrudes outwardly from surface 32 at an oblique angle. Central portion 60 of the spring clip fits in a groove 62 in the back of the picture frame (as shown in FIG. 9) after the clip has been mounted to the back of the frame and the frame has been lowered to its supporting position shown in FIG. 3. The spring can be released from the groove simply by slipping a tool with a thin blade, such as tool 64 (shown in FIG. 11) between the hanger member and the back of the frame. The tool will engage the angled surface of the spring member and cause the spring member to be depressed out of engagement with the groove. The picture frame can thereafter be pivoted to remove the hanger members from the wall.

Tool 64 can also be used for another purpose. In order to permit easy pivotal movement of clip 14 before the clip is to be locked in position on the back of the frame, tool 64 can be extended through transverse opening 44 with the central portion 60 of spring 54 depressed below the level of the tool. This will cause the tool to hold the spring in a lowered position within opening 36 in the hanger member. After the clip has been mounted on the back of the frame and on the wall and the frame lowered to its supporting position shown in FIG. 3, the tool can be removed from the transverse opening, permitting the spring clip to deflect through opening 36 into contact with groove 62. Tool 64 can have a flat wide blade 66 at one end thereof to facilitate removal of the spring from the groove and to prevent the tool from going all the way through opening 44 in the clip.

Another embodiment of a hanger member 14' employing a locking device to restrain pivotal movement of the picture frame is shown in FIG. 9. In this embodiment, the hanger member is formed of a relatively thin sheet metal plate and is provided with openings 50' and 52' of the same type employed in hanger member 14. An elongated rectangular opening 68 is formed in the center of hanger member 14' and is positioned so as to be opposite groove 62 in the picture frame. A curved spring member 70 has a flat portion 72 at one end with an opening formed therein that mates with opening 52'. The other end 74 is positioned to abut the surface of hanger member 14' adjacent opening 68. A raised central portion 76 is shaped so that it fits through opening 68 and protrudes into opening 62 in the picture frame. The spring member is mounted to the picture frame along with the hanger member 14, with fastener 30' extending both through the opening in end 72 and through opening 52' in the hanger member. This spring member can be resiliently moved out of the groove 62 in the same manner as spring 54 is removed.

The hanger member and spring member can be formed of metal or comparable plastic materials having similar qualities of resilience and rigidity. Desirably, hanger member 14 is formed of a rigid metal plate and spring member 70 is formed of spring steel.

Figure 10:
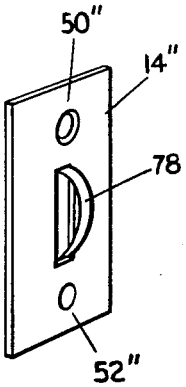
FIG. 10 is a perspective view of still another embodiment of the hanger member of the present invention.

Another embodiment of a hanger member 14'' incorporating a locking device is shown in FIG. 10. In this embodiment, hanger member 14'' comprises a thin flat plate or clip having openings 50'' and 52'' substantially as employed in previous embodiments. A spring clip 78 is formed integrally out of a central portion of this member. Spring section 78 can be formed by deflecting a central portion outwardly from the rest of the plate in a stamping operation employing thin metals. Alternatively, section 78 could be an integrally molded portion of a plastic hanger member of substantially the same design.

It is conceivable that other types of locking devices could be employed to lock the hanger members in a vertical position after the hanger members have both been mounted on the wall.

It should be understood that the foregoing embodiments are merely illustrative of the preferred practice of the present invention and that various changes and modifications may be made in the design and construction of the embodiments disclosed herein without departing from the spirit and scope of the present invention.

The embodiments of the invention in which an exclusive property or privilege is claimed are defined as follows:

1. A non-removable hanger for mounting a picture frame on a wall comprising;

a pair of elongated hanger members that fit behind the vertical sides of the picture frame, the hanger members being formed such that lower portions thereof are pivotably attachable to the back of the picture frame and upper portions of the hanger members are pivotable outwardly to an accessible position on the outer side of the picture frame, the accessible upper portions being pivotably attachable to the wall;

fastener means for pivotably attaching the lower portions of the hanger members to the back of opposite vertical sides of the picture frame for pivotal movement in the plane of the back of the picture frame;

fastener means for alternately pivotably attaching the outwardly extending upper portions of the hanger members to the wall for pivotal movement in the plane of the wall, the fastener means being attachable in positions such that after the hanger members are both attached to the wall and the picture frame is suspended by the hanger members, the fastener means attaching the upper portions of the hanger members to the wall are positioned behind the picture frame; and locking means for locking at least one of the hanger members in position after it has been attached to both the picture frame and the wall and moved to its position to support the picture frame.

2. A non-removable hanger according to claim 1 wherein the hanger members include openings in the upper and lower portions and the fastener means comprise threaded fasteners that fit through the openings into threaded engagement with the picture frame and wall.

3. A non-removable hanger according to claim 2 wherein the hanger members are elongated flat plate members and the openings for the threaded fasteners are countersunk such that the heads of the fasteners are positioned below the surfaces of the plate members and do not scratch the wall when the frame is pivoted from side to side on the wall.

4. A non-removable hanger according to claim 1 wherein the locking means comprise a protrusion on one of the hanger member and picture frame that fits in a mating opening in the other of said picture frame and hanger member, respectively, when the hanger member is pivoted into position to support the picture frame after the hanger member has been mounted on the picture frame and wall.

5. A non-removable hanger according to claim 4 and further comprising means for releasing the locking means so as to permit the picture frame to be pivoted on the wall to expose and remove the fasteners holding the hanger members to the wall.

6. A non-removable hanger according to claim 5 wherein the projection comprises an elongated spring member that extends at an oblique angle between the picture frame and hanger member into the opening, the spring member being releasable from the opening by sliding a thin, flat blade between the hanger member and picture frame against the angled surface of the spring member, such action serving to urge the spring member out of the opening, the picture frame thereafter being pivotable to expose the fasteners attaching the hanger members to the wall, thereby permitting removal of the picture frame from the wall.

7. A non-removable hanger according to claim 6 wherein the elongated spring member comprises opposed separated ends mounted on the hanger member and a central portion extending outwardly from the hanger member, the spring member fitting in a vertical groove in the back of the picture frame and being releasable from the groove by depressing the central portion toward the hanger member.

8. A non-removable hanger according to claim 7 wherein the hanger member comprises an elongated bar having flat surfaces facing the wall and picture frame, with side and end surfaces surrounding the flat surfaces, the bar having a longitudinally oriented elongated recess in the flat surface that faces the picture frame and having longitudinal and transverse openings extending through the recess between the end and side surfaces, respectively, of the bar, the spring member fitting in the recess with the ends of the spring member resting in the longitudinal opening at each end of the recess, the central portion of the spring member being depressed inside the opening opening in the flat surface with a restraining tool passing through the transverse opening and over the spring to hold it down until the hanger is fully mounted, at which time the tool is removable to permit the spring to protrude to lock the hanger member in place on the frame.

9. A non-removable hanger according to claim 6 wherein at least one hanger member comprises a flat plate having openings at spaced locations along the plate, with the fastener means comprising threaded fasteners that fit through the openings, the flat plate also having an elongated opening therethrough, the elongated spring member comprising an end having an opening that mates with one of the fastener openings in the plate and receives the threaded fastener therethrough, the spring member having an outwardly extending portion that fits through the elongated opening in the plate and protrudes outwardly at an oblique angle to fit into an opening formed in the back side of the frame to lock the frame in position on the wall.

10. A non-removable hanger according to claim 6 wherein at least one hanger member is formed of a resilient material in the shape of a flat plate having spaced openings therethrough, the fastener means comprising threaded fasteners that fit through the openings, the spring member comprising an outwardly extending portion of the flat plate that is partially cut out of the flat plate and deflected outwardly therefrom at an oblique angle from the plate, the outwardly extending portion fitting in an opening in the picture frame and being resiliently movable back towards the plane of the plate to release the hanger member from its vertical position.

11. A non-removable, concealed hanger for mounting a picture frame on a wall comprising a pair of elongated hanger members having front and back surfaces that abut the picture frame and wall respectively, each hanger member having openings extending through the front and back surfaces at both ends thereof, the hanger members being pivotably attached at one end to opposite sides of the picture frame by means of fasteners that extend through the openings at said one end and into the frame, each hanger member being sufficiently long that the other end and the opening therethrough are accessible when the other end is pivoted outwardly from the frame, the other end of each hanger being pivotably attached to the wall by a fastener that extends through the opening in that end into the wall, said other ends of the hanger members being spaced apart on the wall by about the same distance as the ends attached to the frame such that the hanger members are positioned approximately vertically and are concealed behind the side edges of the picture frame with the lower ends of the hanger members being attached to the picture frame when the picture frame is hanging from the hanger on the wall, the hanger being removable and mountable on the wall by sideways movement of the picture frame on the wall, whereby the fasteners in said other ends of the hanger members can be exposed for removal or attachment, the hanger further comprising locking means for locking at least one of the hanger members in position after it has been attached to both the picture frame and the wall and moved to its position to support the picture frame.

12. A hanger according to claim 11 wherein the fasteners include means for impairing direct axial removal of the fasteners from the wall and frame, whereby removal of the frame by pulling it away from the wall is resisted.

13. A non-removable picture frame hanger for mounting a picture frame on a wall comprising:

a pair of flat plate members each having at least two spaced openings therein;

fastener means that fit through one of the openings on each plate member for pivotably mounting the plate members on opposite vertical sides of the picture frame in a position such that each plate member is pivotable behind the picture frame and can be moved outwardly to the side of the picture frame such that the other opening in the plate member is accessible for attachment to the wall;

fastener means for alternately pivotably attaching each plate member to the wall by means of the other opening in the plate member, the plate members being attached to the wall in a position such that the fastener means extending through said other openings are concealed behind the picture frame when the frame is mounted on the wall and suspended by the picture frame hanger; and locking means for locking at least one of the hanger members in its vertical position behind the side of the picture frame after it has been attached to both the picture frame and the wall, the locking means being selectively releasable to permit pivotal movement of the picture frame to expose and remove the fastener means holding the hanger members to the wall.

* * * * *